US009222307B2

(12) United States Patent
Gallup et al.

(10) Patent No.: US 9,222,307 B2
(45) Date of Patent: Dec. 29, 2015

(54) LOCKING JOINT FOR COLLAPSIBLE LADDERS AND OTHER STRUCTURES

(75) Inventors: Benjamin Gallup, Cambridge, MA (US); Nathan Ball, Somerville, MA (US); Bryan Schmid, Brookline, MA (US); Daniel Walker, Cambridge, MA (US)

(73) Assignee: Atlas Devices, LLC, Boston, MA (US)

( * ) Notice: Subject to any disclaimer, the term of this patent is extended or adjusted under 35 U.S.C. 154(b) by 24 days.

(21) Appl. No.: 13/584,064

(22) Filed: Aug. 13, 2012

(65) Prior Publication Data

US 2013/0037351 A1 Feb. 14, 2013

Related U.S. Application Data

(60) Provisional application No. 61/522,924, filed on Aug. 12, 2011.

(51) Int. Cl.

| | |
|---|---|
| ***E06C 7/50*** | (2006.01) |
| ***E06C 1/10*** | (2006.01) |
| ***E06C 7/08*** | (2006.01) |
| ***E06C 1/32*** | (2006.01) |
| ***E06C 1/52*** | (2006.01) |

(52) U.S. Cl.

CPC ... *E06C 7/50* (2013.01); *E06C 1/10* (2013.01); *E06C 1/32* (2013.01); *E06C 1/52* (2013.01); *E06C 7/087* (2013.01)

(58) Field of Classification Search

CPC ..... E06C 1/383; E06C 1/32; E06C 1/54; E06C 1/10; E06C 1/52; E06C 7/50; E06C 7/087

USPC ..... 182/129, 164, 104, 152, 156, 163, 22; 403/62, 92–95, 102; 16/319, 337, 341, 16/343, 344, 345, 347, 349, 374, 376

See application file for complete search history.

(56) References Cited

U.S. PATENT DOCUMENTS

| | | | | |
|---|---|---|---|---|
| 628,824 | A * | 7/1899 | Maier | 182/164 |
| 1,800,349 | A | 4/1931 | Hurason | |
| 3,231,045 | A * | 1/1966 | Louis Lavrard Georges | 182/164 |
| 3,698,512 | A | 10/1972 | Cebular | |
| 3,757,896 | A * | 9/1973 | Lee | 182/164 |
| 4,067,413 | A * | 1/1978 | Olsen | 182/164 |
| 4,493,392 | A * | 1/1985 | Alimbau Marques | 182/27 |
| 4,751,982 | A * | 6/1988 | Wolfe | 182/164 |
| 4,773,503 | A | 9/1988 | Purkapile | |
| 4,926,967 | A | 5/1990 | Baker et al. | |
| 4,947,959 | A | 8/1990 | Yuen | |

(Continued)

OTHER PUBLICATIONS

International Search Report and Written Opinion mailed Oct. 26, 2012 (14 Pages).

*Primary Examiner* — Charles A Fox
*Assistant Examiner* — Kristine Florio
(74) *Attorney, Agent, or Firm* — Nutter McClennen & Fish LLP

(57) ABSTRACT

A rigid structure such as a ladder is disclosed having rotating hinges that allow the ladder to fold up and/or be disassembled and assembled. The hinge or hinges can be provided between ladder sections with one ladder section having a male hinge element, and another having a female hinge element. A cam element provided with the female hinge element can be moved between an unlocked position in which the ladder sections can rotate with respect to each other, and a locked position in which the structure is rigid.

13 Claims, 15 Drawing Sheets

(56) References Cited

U.S. PATENT DOCUMENTS

| | | | | |
|---|---|---|---|---|
| 5,022,118 | A * | 6/1991 | Wan-Li | 16/327 |
| 5,142,739 | A * | 9/1992 | Lin | 16/326 |
| 5,163,532 | A | 11/1992 | McCarty | |
| 5,211,260 | A * | 5/1993 | Toycen | 182/164 |
| 5,279,387 | A * | 1/1994 | Swiderski et al. | 182/27 |
| 5,353,892 | A * | 10/1994 | Lu | 182/163 |
| 6,397,433 | B1 | 6/2002 | Chen | |
| 6,711,780 | B2 | 3/2004 | Lee | |
| 7,093,321 | B2 | 8/2006 | Burbrink et al. | |
| 8,051,508 | B2 | 11/2011 | Yu et al. | |
| 2004/0023700 | A1 | 2/2004 | Gupte | |
| 2004/0216277 | A1 * | 11/2004 | Beaver | 16/324 |
| 2004/0218968 | A1 * | 11/2004 | Beaver et al. | 403/95 |

* cited by examiner

LOCKING JOINT FOR COLLAPSIBLE LADDERS AND OTHER STRUCTURES

RELATED APPLICATIONS

The present application claims the benefit under 119(e) of United States provisional patent application U.S. Appl. No. 61/522,924, filed on Aug. 12, 2011 and entitled "ZERO BACKLASH, HIGH TORQUE, SEPARABLE LOCKING JOINT FOR COLLAPSIBLE LADDERS AND OTHER STRUCTURES," the disclosure of which is incorporated by reference in its entirety.

FIELD OF THE INVENTION

The present invention relates to mechanisms for locking separate members together such that they form a single rigid member. More particularly, the invention relates to a mechanism that physically locks a rotating joint such that the members comprising the joint become a single rigid member suitable for use in stiff structures such as ladders which can collapsed and deployed.

BACKGROUND

Ladders are a universal tool for gaining access to otherwise unreachable places. However, ladders typically being configured as long, rigid structures make them inherently cumbersome to transport and store.

Many ladders exist that try to improve the convenience of transport and storage by telescoping, folding up, and in some cases disassembling. Articulated ladders that feature locking rotational joints are a common solution. Commonly, adjacent rails that comprise the folding sections of the ladder feature discs at each end with interlocking features. These features may be configured in many ways, including pins in holes and positive/negative locking elements that encircle the axis of the rotary locking joint. Additional parts of the mechanisms may be employed to hold the joints in their locked position once deployed.

Despite that many folding and locking mechanisms have been designed to suit ladders and other collapsible structures, several problems restrict their usability to ladders that (a) do not have a large number of folding sections, (b) are not very long, (c) cannot support a high load, or (d) cannot easily disassemble or be assembled modularly to increase the ladder's length. To create a ladder that can collapse into an exceptionally small package that includes many sections, is long enough to reach significant climbing heights such as 30 feet, carry a heavy dynamic load up to 350 lbs, and be reconfigurable such that it can be separated into a desirable number of smaller sub-sections.

SUMMARY

The invention pertains to a rigid structure having a rotating hinge joint. In one aspect, a ladder is provided having a first ladder section and a second ladder section, with the ladder sections having connecting ends. A female hinge element is provided on a first one of the first and second ladder section connecting ends and has an opening with a cam surface. A male hinge element is provided on a second one of the first and second ladder section connecting ends and has a transverse connector having a cam follower, the transverse connecting element extending into the opening in the female hinge element such that the cam follower contacts the cam surface. Movement of the male and female hinge elements to an unlocked position allows the first and second ladder sections to rotate relative to each other while movement of the male and female hinge elements to a locked position causes the first ladder section locking feature and the second ladder section locking feature to engage each other to prohibit relative rotation between the first and second ladder sections. In some embodiments, the cam surface is an internal cam surface. In other embodiments, the cam surface can be provided on a cam element that moves in a plane that is parallel to a major surface of a rail with which the cam element is associated. In still further embodiments, the cam surface can be arranged so that the hinge can be moved to a disassembly position where the male and female hinge elements can be assembled or disassembled.

Differing embodiments of the invention can provide a number of features and advantages, including the enumerated objectives below which should be seen as optional, but may be found in various embodiments or implementations of the invention in any combination or sub-combination.

One object of the present invention can be to provide a mechanism for locking together two rigid members which solves one or more of the problems associated with the conventional methods and techniques described above.

Another object of the present invention can be to provide a mechanism for locking together two rigid members which can be manufactured at reasonable costs.

Other objects and advantages of the present invention will be apparent to one of ordinary skill in the art in light of the ensuing description of the present invention. One or more of these objectives may include:

(a) to provide a mechanism that enables rotation between two rigid structural members;
(b) to provide a mechanism that can forcefully lock together two rigid structural members together, restricting all relative motion between the two even under heavy load;
(c) to provide a mechanism that can be operated by hand with no tools;
(d) to provide a mechanism that can support an exceptionally high torque between the two rigid members it is locking together;
(e) to provide a mechanism that can allow complete separation of the two rigid members it can lock together;
(f) to provide a mechanism that enables a ladder to fold into a substantially shorter package size;
(g) to provide a mechanism that enables a folded ladder to deploy to its full length and support the load of a climber;
(h) to provide a mechanism that preferentially only locks into place in a single rotational position;
(i) to provide a mechanism that resists no rotational motion until the singular rotational position is achieved wherein it locks;
(j) to provide a mechanism that includes a spring which preloads the mating features to lock when aligned; and
(k) to provide a mechanism that includes a cam whose action forces the mating features of the mechanism together.

BRIEF DESCRIPTION OF THE DRAWINGS

The invention will be more fully understood from the following detailed description taken in conjunction with the accompanying drawings, in which.

DETAILED DESCRIPTION

The invention provides a rigid structure, in particular a ladder, having rotating hinges that allow the ladder to fold up and/or be disassembled and assembled. The hinge or hinges can be provided between ladder sections with one ladder section having a male hinge element, and another having a female hinge element. A cam element provided with the female hinge element can be moved between an unlocked position in which the ladder sections can rotate with respect to each other, and a locked position in which the structure is rigid.

Certain exemplary embodiments will now be described to provide an overall understanding of the principles of the structure, function, manufacture, and use of the systems and methods disclosed herein. One or more examples of these embodiments are illustrated in the accompanying drawings. Those skilled in the art will understand that the systems and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Figure 1A:
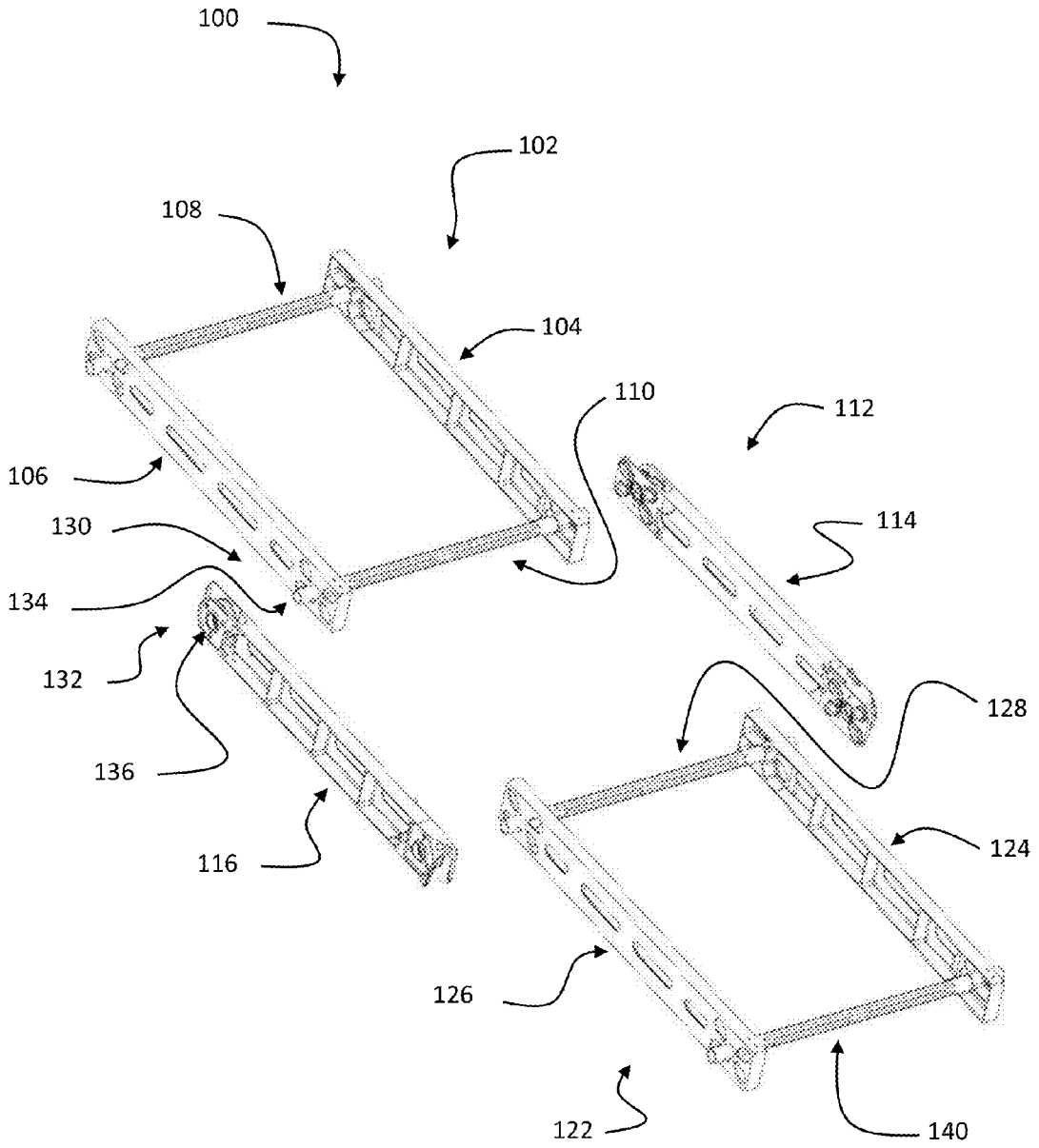
FIGS. 1A and 1B provide a view of the joint employed in a ladder, with the joint disassembled and also assembled and locked.
Figure 1B:
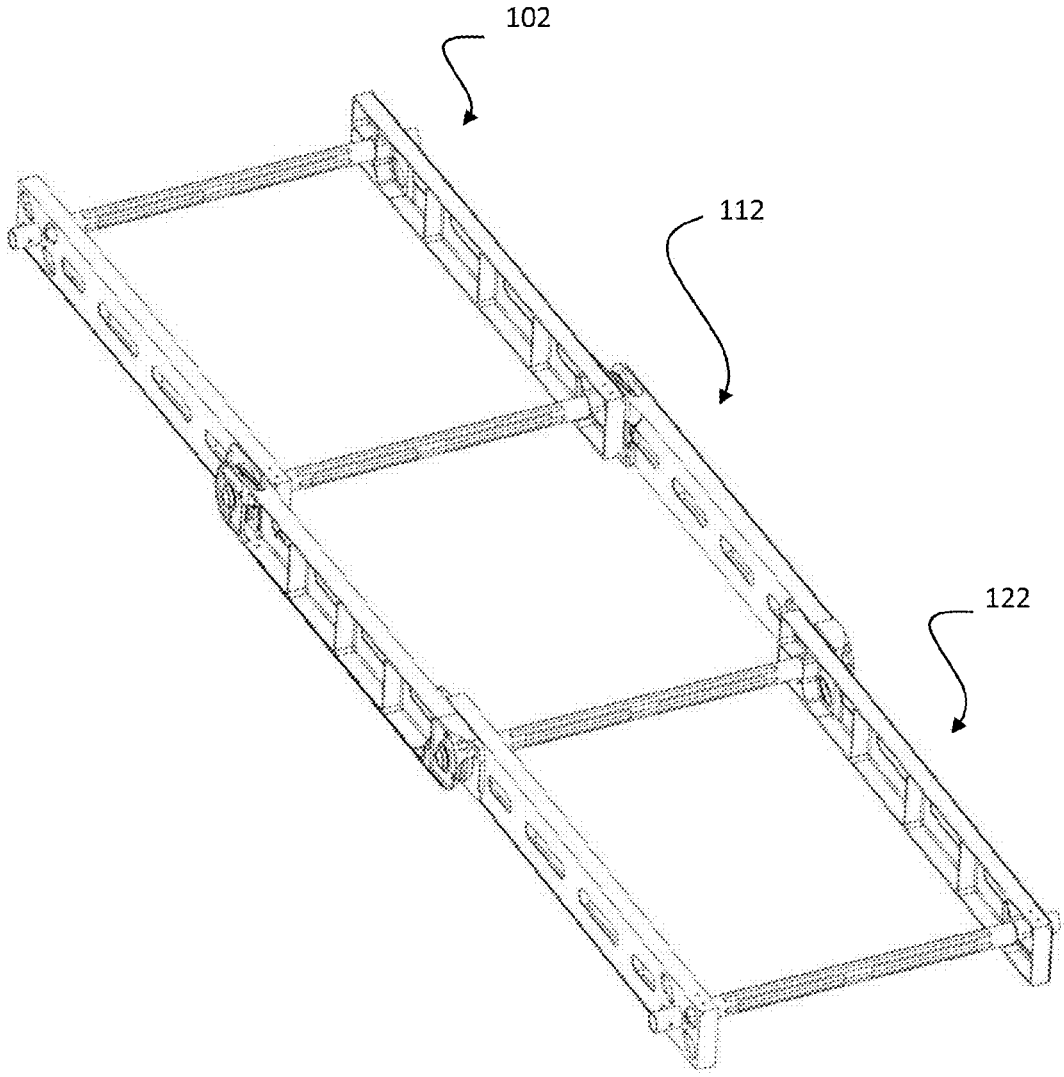

FIGS. 1A and 1B illustrate a rigid member 100 of the invention, in this case, a ladder 100. The ladder 100 is illustrated as three separate parts (first ladder section 102, second ladder section 112, and third ladder section 122) in FIG. 1A, and assembled in FIG. 1B. While the embodiment of these Figures shows three ladder sections, two ladder sections or more than three ladder sections may be employed in keeping with the invention.

A first ladder section 102 has right and left rails 104, 106, as well as top and bottom rungs 108, 110. Each of the rungs extends across from one rail to the other, in this case with each rung being perpendicular to each rail. While many ladders have two rails, it should be understood that the invention can be applied with a rigid member having at least one rail, and possibly having more than two rails. Configurations other than perpendicular could also be provided. Further, while the illustrated ladder section 102 has two rungs—other ladder sections may have zero, one, or more than two rungs. First ladder section 102 also has a connecting end 130, which may be connected to additional ladder sections. As illustrated, first ladder section has two identical connecting ends, one at the top and one at the bottom, but only one connecting end 130 is used in the Figure. On the connecting end 130, the first ladder section has a male hinge element 134. As illustrated, the first ladder section has four such male hinge elements, the details of which will be described further below.

A second ladder section 112 is also illustrated in FIGS. 1A and 1B. This section consists of two rails—right and left rails 114, 116. More or fewer rails may be provided and the second ladder section might also have one or more rungs in some embodiments. The second ladder section also has a connecting end 132 having a female hinge element 136. As illustrated, the second ladder section includes two connecting ends, both of which are used in the exemplary embodiment, and 4 female hinge elements—one each on each connecting end of each rail in the section.

A third ladder section 122 is also illustrated in FIGS. 1A and 1B. The third ladder section 122 includes right and left rails 124 and 126 with top and bottom rungs 128, 140 extending perpendicularly between the two rails. As with the first ladder section, other configurations of ladder section may be used within the spirit of the invention.

The ladder sections 102, 112, 122 are assembled to create the ladder assembly of FIG. 1B. The rails of the first and third ladder sections are "inside" rails, while the rails of the second ladder section are "outside" rails in the sense that when the hinges are assembled, the second ladder section rails are place laterally outside with respect to the first and third ladder assembly rails. In the illustrated embodiment, a portion of the rungs in the first and third ladder assemblies may extend through the "inner" rails to become the male hinge portions. The female hinge elements of the "outer" rails can then slide over the male hinge portions to complete the assembly. In addition, the hinges and locking features can be arranged so that the ladder sections are not locked in a perfectly straight line, but rather in a slight arc that makes the ladder stronger and more stable.

Figure 2A:
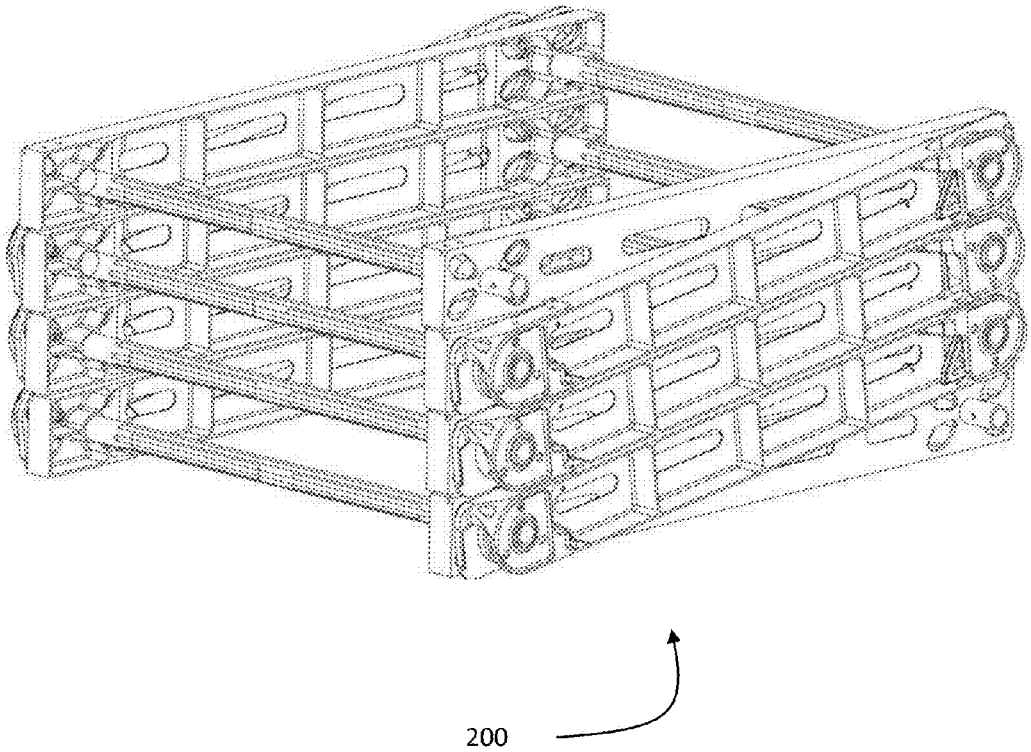
FIGS. 2A and 2B show several ladder sections that can be extended to 10 feet in length, both folded for stowage and deployed and locked, ready for climbing.
Figure 2B:
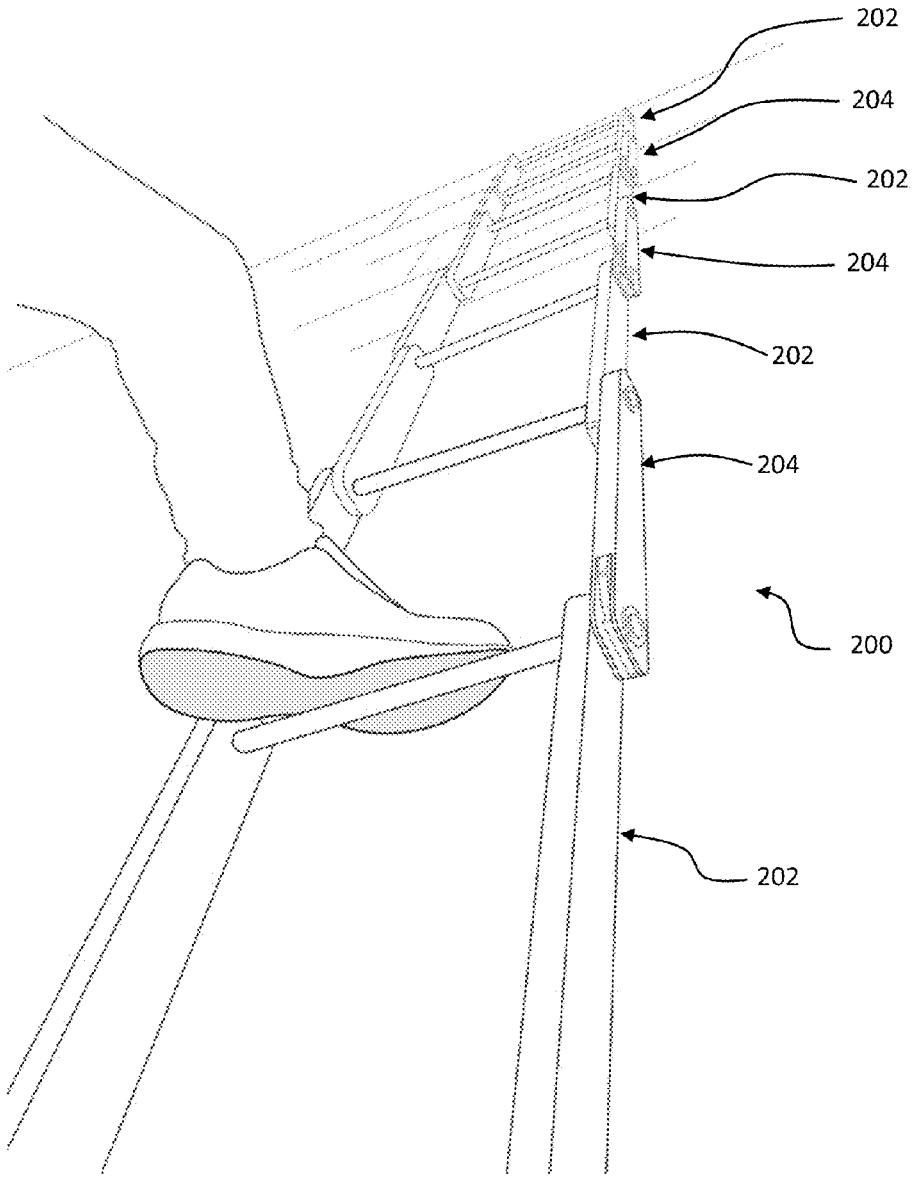

FIGS. 2A and 2B illustrate a ten foot ladder 200 built using four ladder sections 202 having two rails and two rungs (in this case, each of these ladder sections is substantially identical to the first or third ladder sections above) and three ladder sections 204 having only two rails (the "outer" rails in the figures, and these are substantially identical to the second ladder section above). In FIG. 2A, the ladder 200 is folded up about its hinges so that in the X and Y dimensions, the ladder assembly is the same size as a single first ladder section 102/202. In FIG. 2B, the ladder 200 is unfolded about its hinges and locked into its configuration for use as a ladder.

Figure 3A:
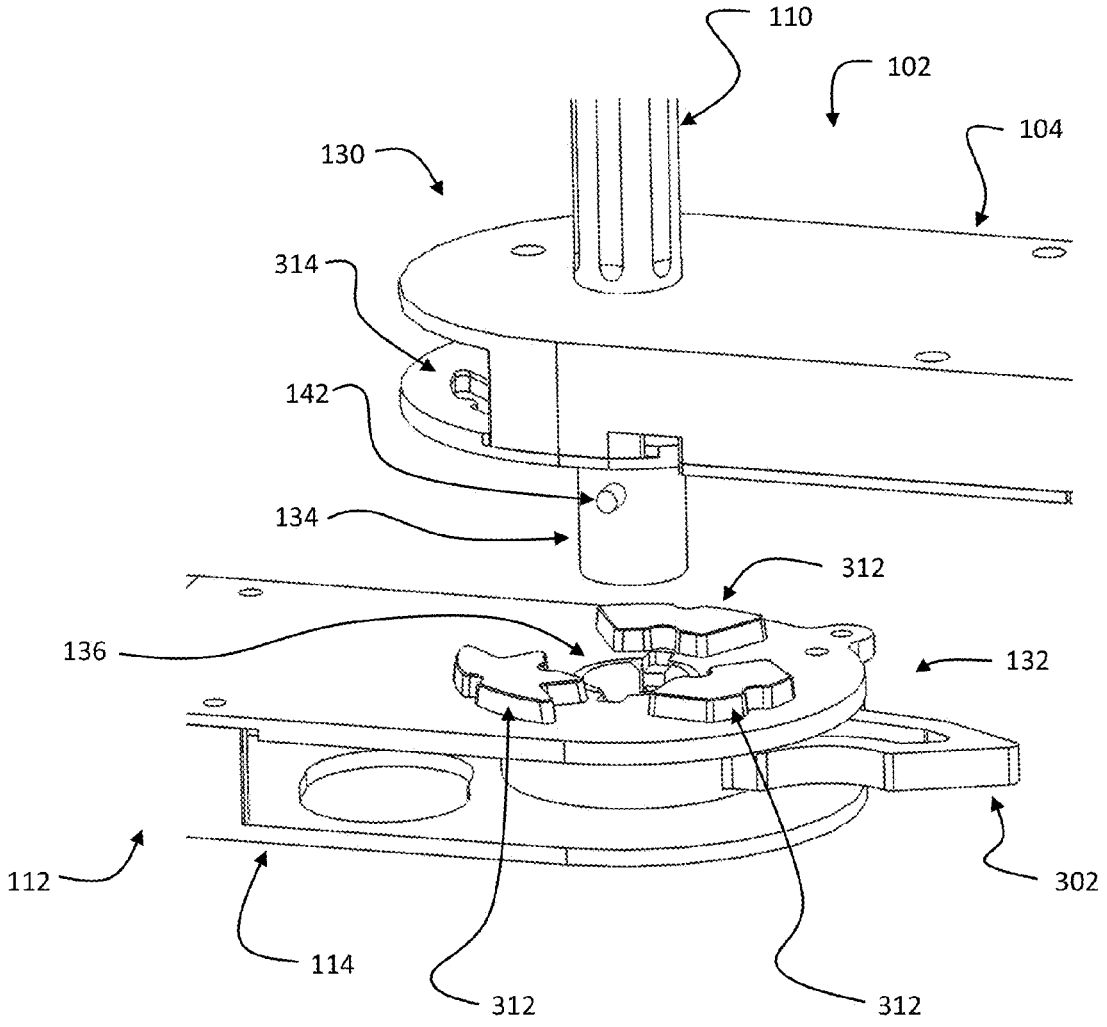
FIGS. 3A and 3B provide detailed views of the hinge and cam elements of the ladder of FIGS. 1A and 1B.

FIG. 3A illustrated an exploded view of a hinge that can be used with the invention. The figure shows right rail 104 and bottom rung 110 of the connecting end 130 of first ladder section 104, as well as the right rail 114 of the connecting end 132 of second ladder section 112. Male hinge element 134 is a transverse connecting element extending from rung 110 through rail 104, and includes a pin 142 extending through the male hinge element transversely to act as a cam follower. The pin 142 can extend outward from both of opposed sides of the male hinge element. The male hinge element 134 can extend into female hinge element 136 in rail 114. In this way, male hinge element 134 can act as an axle about which the second ladder section 112 can rotate about the first ladder section 102.

Figure 3B:
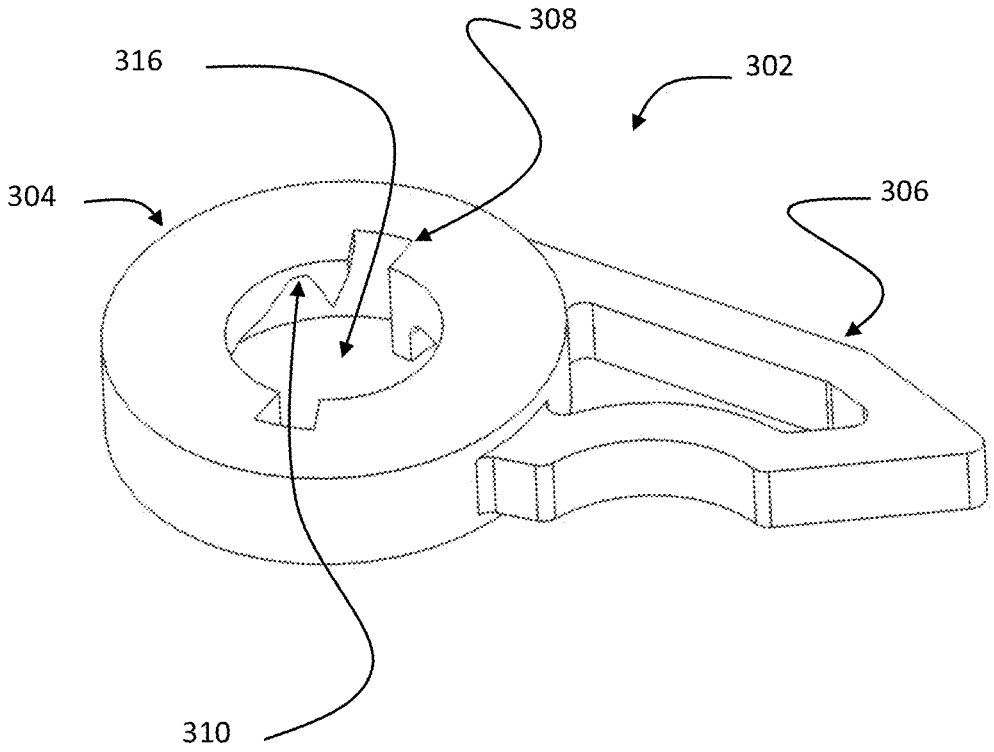

Disposed at least partially within rail 114 and aligned with an opening in the rail to form part of the female hinge element 136 is a rotating cam element 302. The rotating cam element 302 is illustrated in isolation in FIG. 3B. The rotating cam element 302 includes a body 304 and a handle 306 that can be used to rotate the body. The body 304 includes a central opening 316 for receiving the male hinge element 134. The opening 316 can include slots 308 that allow the pin 142 (or cam follower) to pass in and out when the cam is rotated to an assembly or disassembly position. Such a position is illustrated in FIG. 3A where the slots 308 in the rotating cam element 302 are aligned with similar slots in the opening in rail 114, and further the pin 142 on male hinge element 134 is aligned with slots 308 so that male hinge element can slide into (or out of) the female hinge element in this orientation.

A cam profile 310 is provided internally along the opening 316 in the rotating cam element 302. In general, an internal cam surface or profile, as used herein, refers to a cam surface that is provided within the outer perimeter of the element on which it is located. An internal cam surface does not refer to rotating cam elements that use their outer perimeter as the cam surface when they rotate about an axis that is transverse to the direction of the camming motion. When the illustrated ladder sections are not moving with respect to each other, relative rotation of the rotating cam element 302 with respect to the rail 114 in which it is positioned will cause relative movement between the cam profile 310 and the cam follower (or pin) 142. This rotation results in relative movement between the ladder sections in a direction that is transverse to a plane parallel to a major surface of rail 114, which, in the illustrated embodiment, is also transverse to a plane parallel to a major surface of rail 104 and along the longitudinal axis of rung 110.

In the illustrated embodiment, rotating the rotating cam element 302 to an unlocked position, allows the rails 104, 114 to move apart, which allows them to rotate with respect to each other. Rotating the rotating cam element 302 to a locked position, pulls the rails 104, 114 together, causing locking features on the rails to engage each other and prevent relative rotation between the rails.

As shown in FIG. 3A, outer rail 114 is provided with positive locking features 312, while inner rail 104 includes corresponding negative locking features 314. A person of ordinary skill will understand that other configurations are possible, including switching the locations of the positive and negative locking features. In addition, while three sets of complimentary locking features are illustrated, in other embodiments, more or fewer locking features may be provided. Further, the illustrated positive locking features 312 are provided in three different shapes (as are the complementary negative locking features 314). This feature can be useful in that it allows the ladder sections to rotate freely with respect to each other without risk of the locking features engaging until the ladder sections reach the desired locking position—for a ladder, this will generally be the extended position in which the ladder can be climbed. Other configurations of locking features can be provided, however, it may be preferred to provide at least one locking feature that is differentiated in shape from any other locking features so that the hinge can be locked in only one position.

Figure 4A:
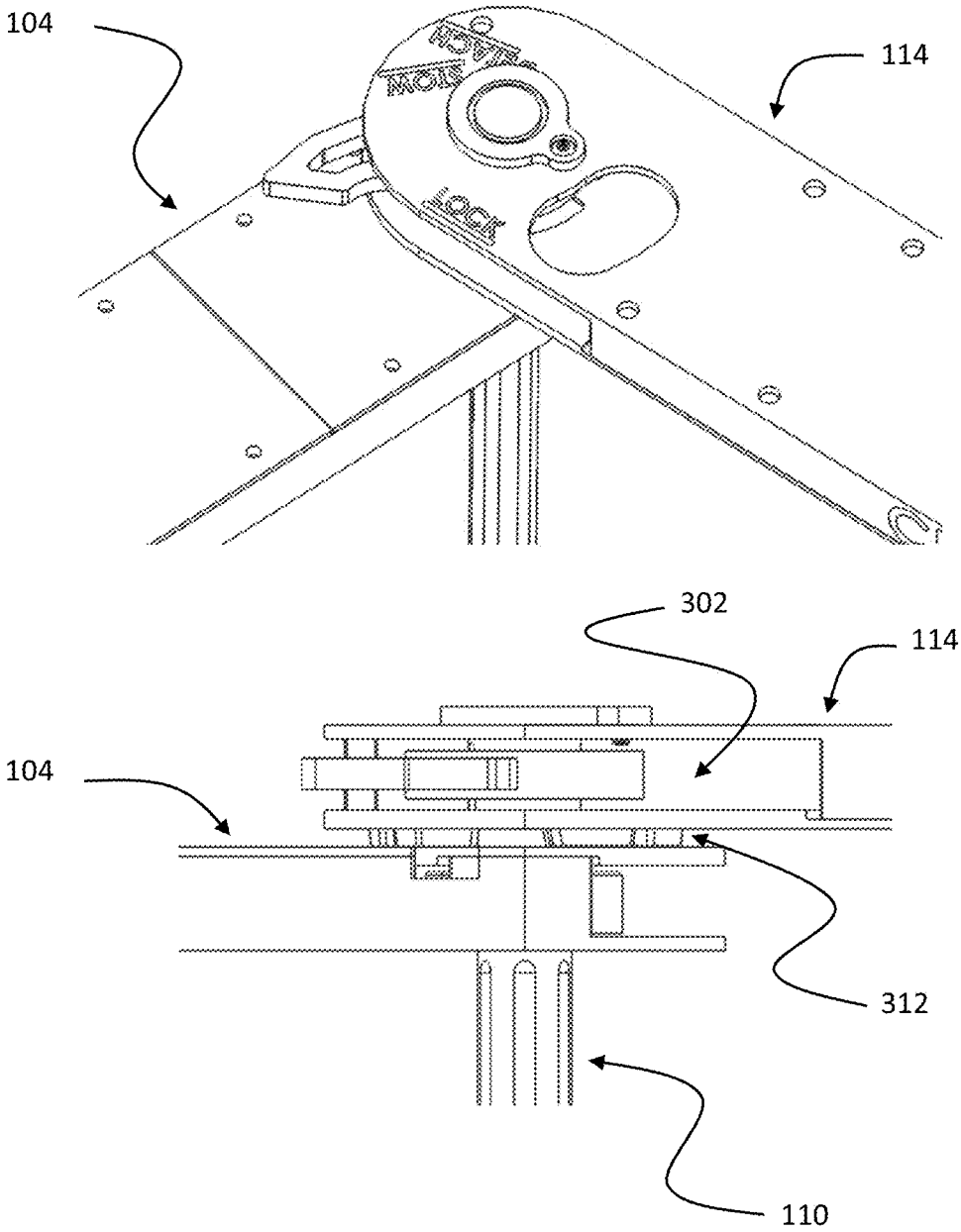
FIGS. 4A and 4B provides a detailed view of the elements of FIGS. 3A and 3B in unlocked and locked positions.
Figure 4B:
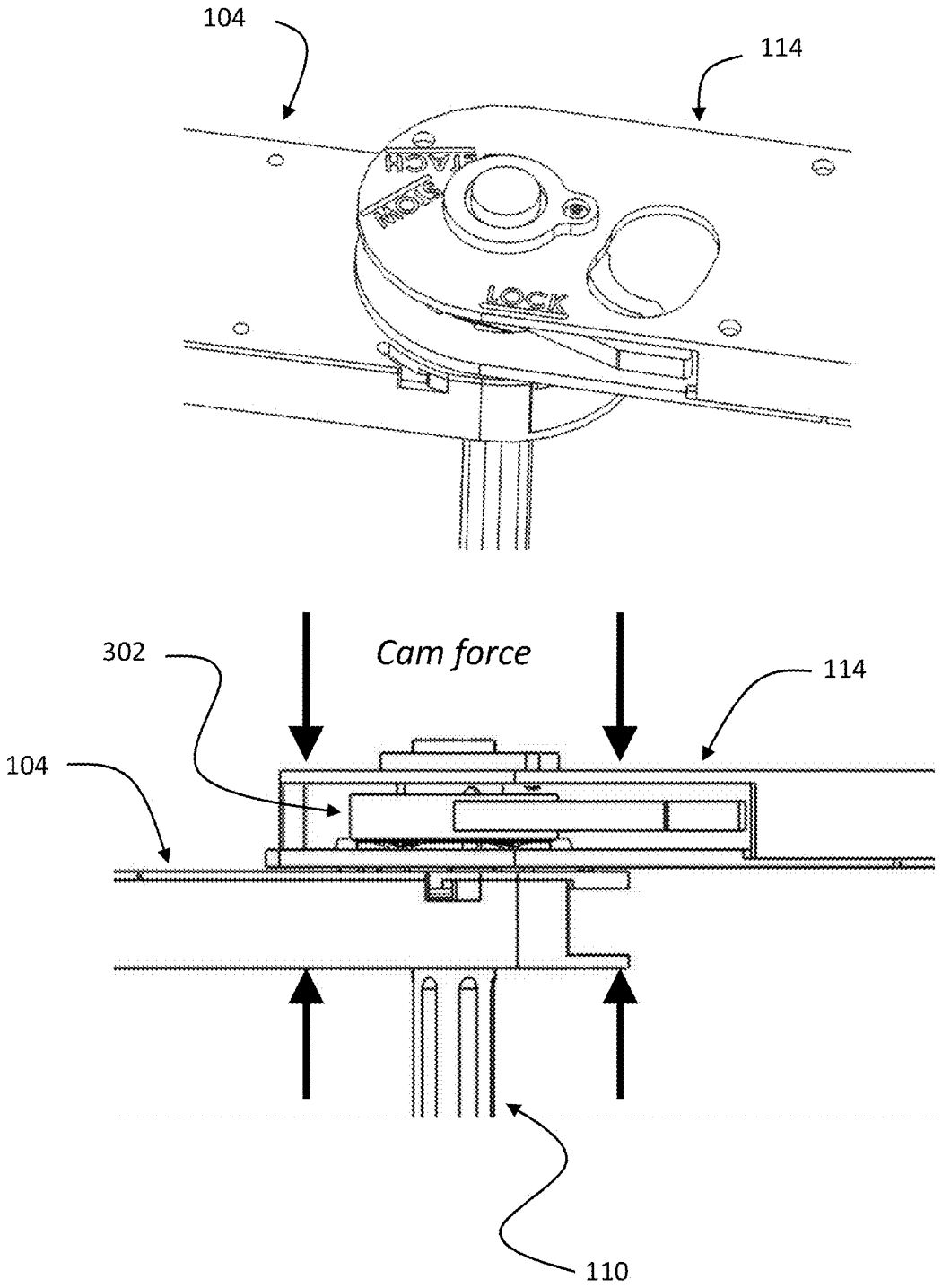

FIGS. 4A and 4B show rails 104 and 114 in unlocked and locked conditions respectively, in both isometric and side views. In FIG. 4A, the rotating cam element 302 is in the unlocked position, the positive locking features 312 have not engaged with the negative locking features 314, and the ladder sections may rotate freely with respect to each other. In FIG. 4B, the rotating cam element 302 has been rotated to the locked position, and it has drawn the rails 104 and 114 together to engage the locking features. In this position, the ladder sections are locked and no relative rotation is possible.

Figure 4C:
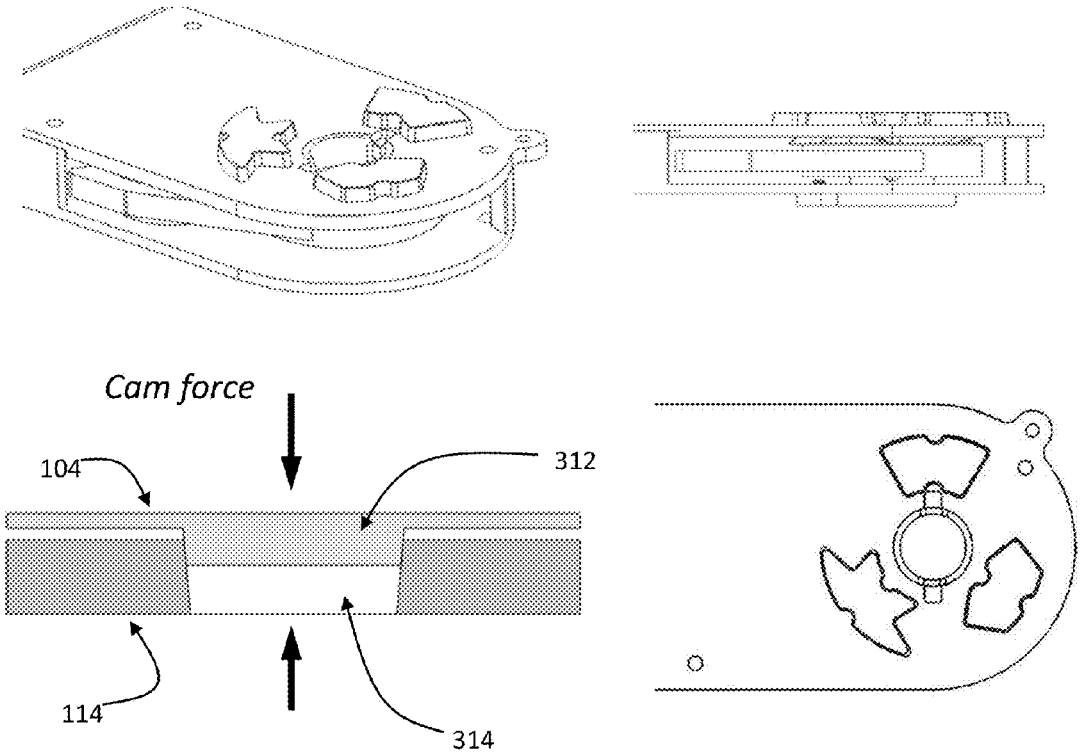
FIG. 4C provides a detailed view of the locking features illustrated in FIG. 3A.

FIG. 4C shows positive 312 and negative 314 locking features coming together under the cam force to lock the relative positions of rails 104, 114. Preferably the locking features provide zero or minimum backlash when engaging. For example, both the positive 312 and negative 314 locking features illustrated are tapered so as to lock the joint with zero backlash when pressed together by the cam.

Figure 5A:
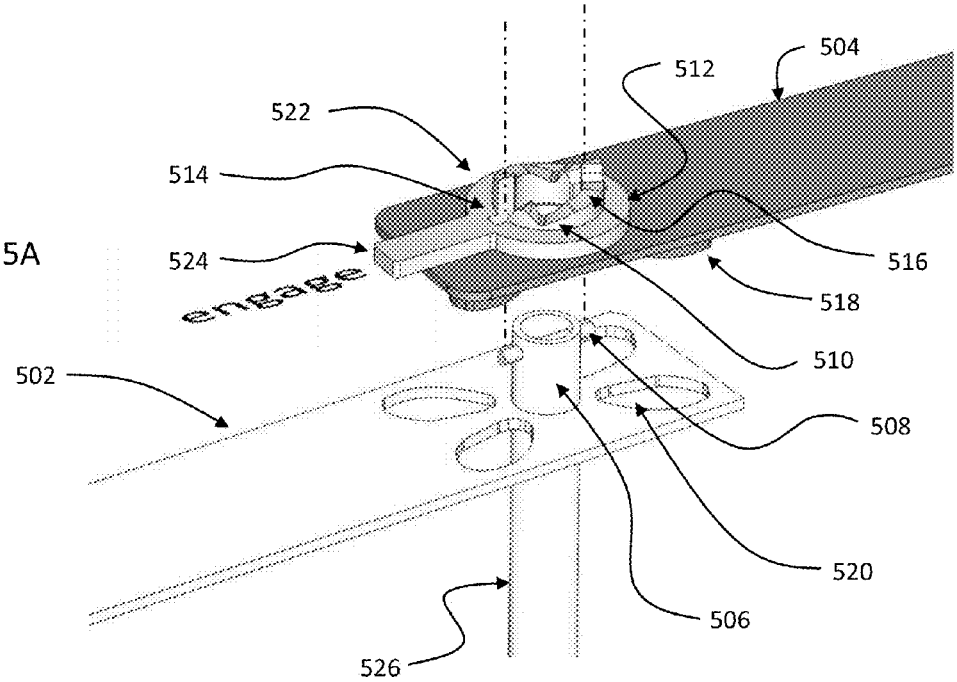
FIGS. 5A through 5G provide views of another hinge useful with the ladder of FIGS. 1A and 1B.
Figure 5B:
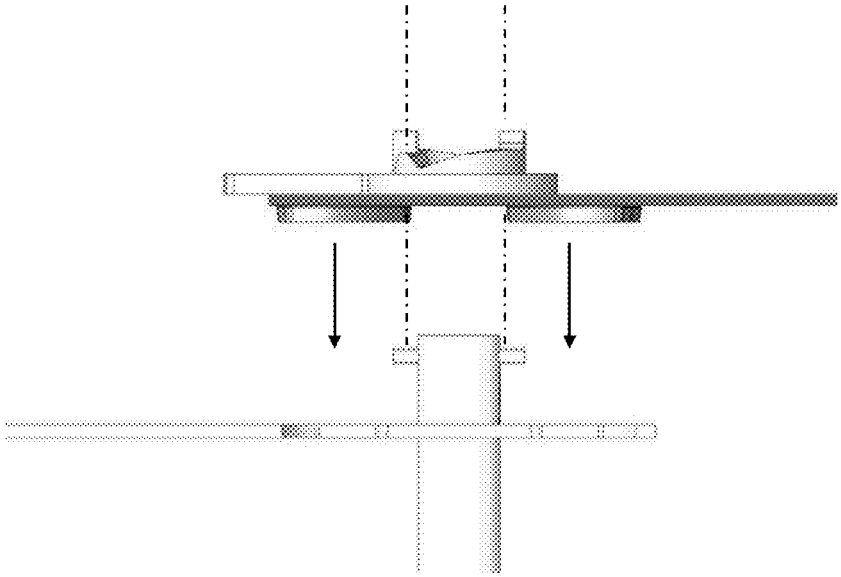

A similar hinge arrangement is further illustrated in FIGS. 5A (isometric view) and 5B (side view) in a disassembled or exploded state. This arrangement includes a ladder section having a rail 502, rung 526, and male hinge element 506. Another ladder section includes rail 504 and female hinge element 510. A rotating cam element 512 is provided as part of the female hinge element and including a handle 524 and body 522. The body 522 defines a central opening having slots 514 to accept the male hinge element 506 having a transverse pin or cam follower 508. An internal cam profile 516 is provided on the body 522 to interact with cam follower 508. Positive 518 and negative 520 locking features are provided on the rails such that the hinge can be locked into position only in an extended-ladder orientation. FIG. 5B shows a side view with the direction of assembly of the ladder sections illustrated.

Figure 5C:
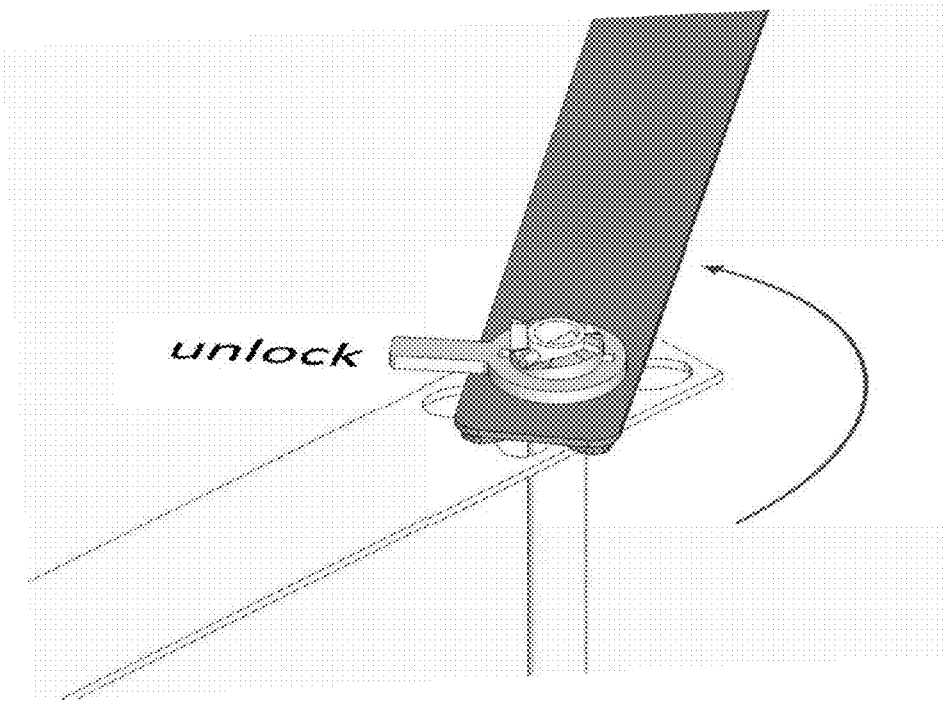
Figure 5D:
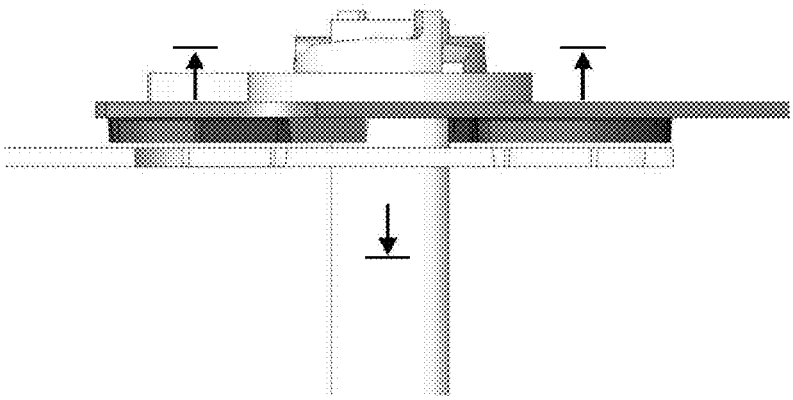

FIGS. 5C and 5D illustrate the elements of FIGS. 5A and 5B where the ladder sections have been assembled and the cam element 512 has been rotated to an unlocked position; the views are isometric and side respectively. In this position, the ladder sections are free to rotate with respect to each other, however, the ladder sections cannot be disassembled. As can be seen most clearly in FIG. 5C, the cam follower 508 is resting at the lowest spot on the cam profile 516, allowing the maximum distance between rail 502 and 504 so that the positive 518 and negative 520 locking features are not engaged.

Figure 5E:
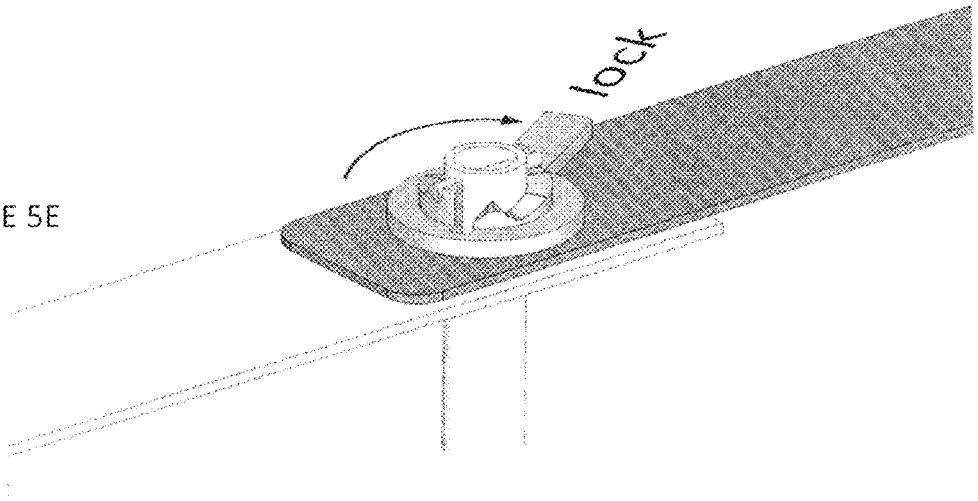
Figure 5F:
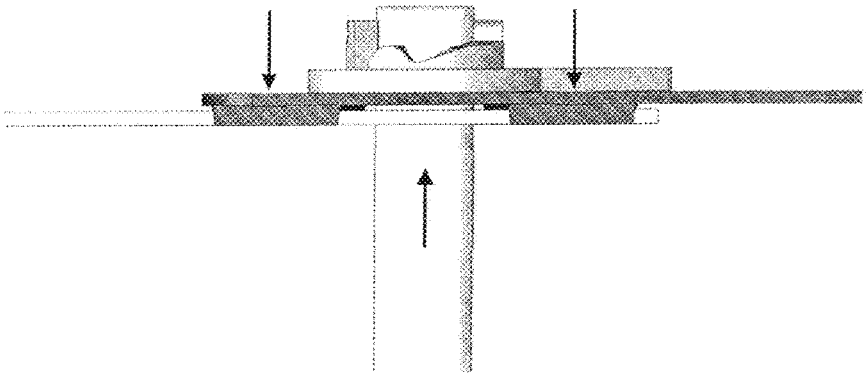

FIGS. 5E and 5F illustrate the elements of FIGS. 5A and 5B where the ladder sections have been assembled and the cam element 512 has been rotated to a locked position; the views are isometric and side respectively. In this position, the ladder sections may not rotate with respect to each other. As can be seen most clearly in FIG. 5C, the cam follower 508 is resting at the highest spot on the cam profile 516, pushing the relative elements to a minimum distance between rail 502 and 504 so that the positive 518 and negative 520 locking features engaged to lock the orientation of the ladder.

Figure 5G:
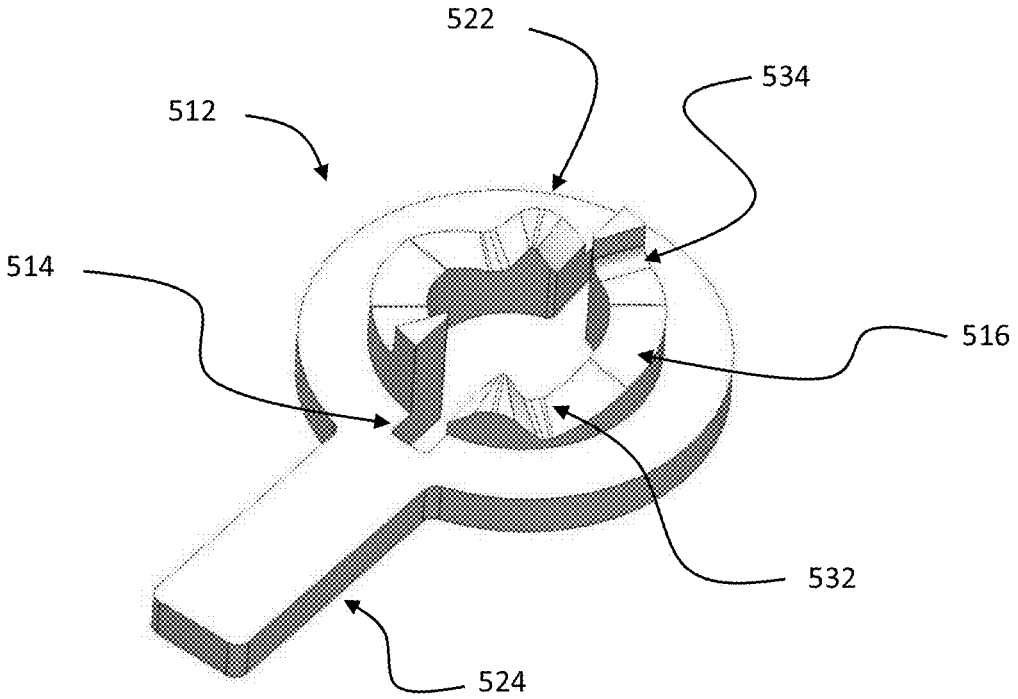

FIG. 5G provides an isometric view of rotating cam element 512. In this Figure, the cam profile 516 is clearly visible and the lowest cam position 532, corresponding to the unlocked position, and the highest cam position 534, corresponding to the locked position can readily be seen.

Figure 6:
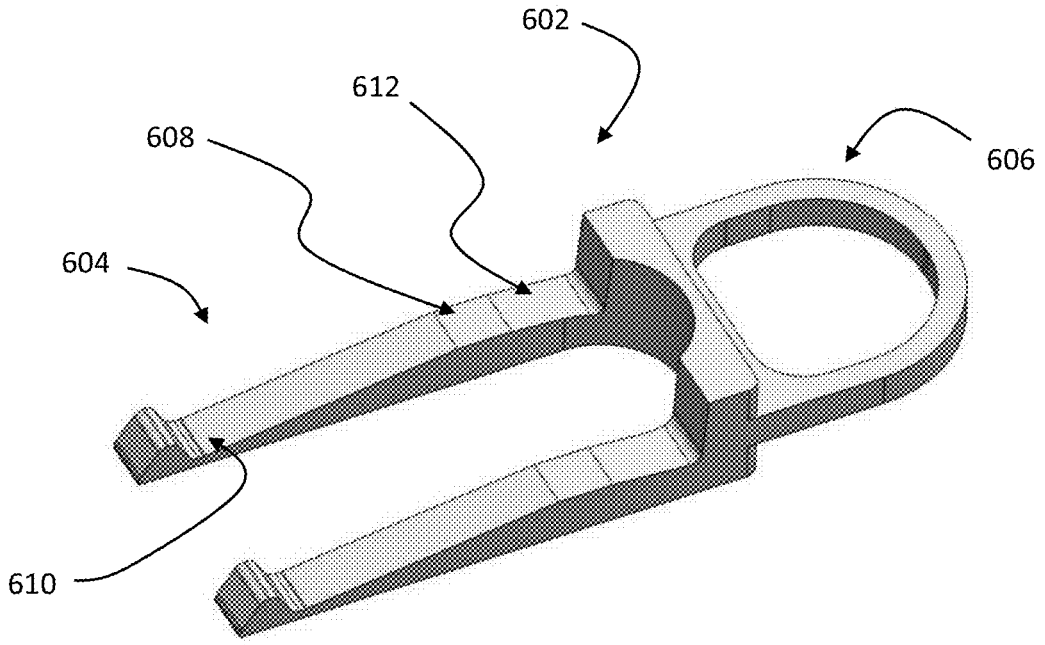
FIGS. 6 and 7 illustrate alternative cam elements for use with the hinges of FIGS. 3A and 3B.

FIG. 6 provides an alternative sliding cam element 602. This cam element has a body 604 and a handle 606. The body has a cam profile 608. As with the other cam profiles, the cam profile 608 is internal as it is within the perimeter of the body 608. The profile includes a lowest point 610, which corresponds to the unlocked position, and a highest point 612, which corresponds to the unlocked position. This cam element can, for example, slide along rail 504 underneath pin 508 so that pushing the cam element 602 in locks the relative positions of the ladder sections, while pulling the cam element 602 out allows the ladder sections to rotate relative to each other, and removing the cam element 602 allows the ladder sections to be disassembled.

Figure 7:
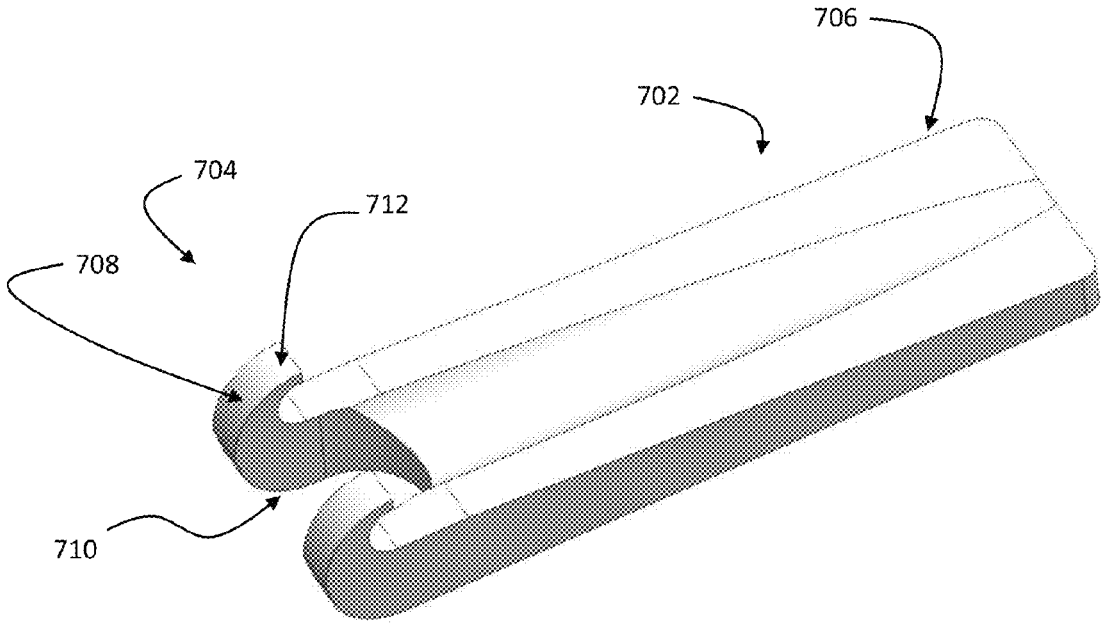

FIG. 7 provides another alternative cam element 702 having a body 704 and a handle 706. In this embodiment, the body "hooks" the pin 508 and rotates about it. The cam profile 708 in this embodiment is provided on the outside of the body and is thus external. The minimum camming or "unlocked" position of the cam profile is illustrated at 712, while the maximum camming or locked position of the cam profile is illustrated at 710. This cam element could be flipped over, "hooked" on the pin 508 so that the cam element could rotate about the pin, and then the cam element could be rotated about the pin with the cam profile sliding against rail 504 until the handle rests up against rail 504 in order to lock the relative positions of the ladder sections.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A ladder comprising:

a first ladder section including two rails and at least two rungs, each rung extending between the two rails, the first ladder section including a first ladder section connecting end having a first ladder section locking feature;

a second ladder section including at least one rail and having a second ladder section connecting end having a second ladder section locking feature;

a female hinge element provided on the second ladder section connecting end and having an opening with an internal cam surface; and a male hinge element provided on the first ladder section connecting end, extending transversely from the rail of the second ladder section, and having a cam follower that extends transversely from the male hinge element, the male hinge element extending into the opening in the female hinge element such that the male hinge element forms an axle about which the first and second ladder sections rotate, the cam follower extending transversely from the male hinge element so that the cam follower contacts the internal cam surface;

wherein movement of the male and female hinge elements to an unlocked position causes relative motion between the cam follower and the internal cam surface that allows the first and second ladder sections to rotate relative to each other while movement of the male and female hinge elements to a locked position causes relative motion between the cam follower and the internal cam surface to move the first ladder section locking feature with respect to the second ladder section locking feature in a direction along an axis of rotation of the male hinge element such that the first ladder section locking feature and the second ladder section locking feature engage each other to prohibit relative rotation between the first and second ladder sections.

2. The ladder of claim 1, wherein the female hinge element opening is provided on a first rail of the second ladder section and extends transversely within the rail.

3. The ladder of claim 2, wherein the internal cam surface is provided on a rotating cam element.

4. The ladder of claim 3, wherein the rotating cam element includes a body and a handle, and can be rotated using the handle to move the cam follower along the internal cam surface so as to move the hinge elements between an unlocked and a locked position.

5. The ladder of claim 4, wherein the rotating cam element rotates about the male hinge element.

6. The ladder of claim 4, wherein the rotating cam element rotates about the male hinge element and in a plane that is parallel to a major surface of the first rail of the first ladder section.

7. The ladder of claim 2, wherein the internal cam surface is provided on a sliding cam element and includes a body and a handle, and can be slid using the handle to move the cam follower along the internal cam surface to as to move the hinge elements between an unlocked and a locked position.

8. The ladder of claim 1, wherein the locking features include a plurality of positive and negative locking features configured so that the ladder sections can be locked in only one orientation.

9. The ladder of claim 1, wherein the locking features include positive and negative locking features that are configured to provide zero backlash upon locking.

10. The ladder of claim 9, wherein the positive and negative locking features include complementary tapers that result in zero backlash upon locking.

11. The ladder of claim 1, wherein the second ladder section consists of two rails and includes first and second connecting ends with a female hinge element provided at the second ladder second connecting end and locking features provided at each of the two second ladder connecting ends, the ladder further comprising a third ladder section including two rails and at least two rungs, each rung extending between the two rails, the third ladder section including a third ladder section connecting end having a third ladder section locking feature; and a male hinge element provided on third ladder section connecting end, extending transversely from a first of the two third ladder section rails, and having a cam follower, the cam follower extending transversely from the male hinge element into the opening in a female hinge element on the second ladder section such that the cam follower contacts the internal cam surface;

wherein movement of the third ladder section male hinge element and second ladder section female hinge element to an unlocked position allows the second and third ladder sections to rotate relative to each other while movement of the third ladder section male hinge element and second ladder section female hinge element to a locked position causes the second ladder section locking feature and the third ladder section locking feature to engage each other to prohibit relative rotation between the second and third ladder sections.

12. The ladder of claim 1, wherein moving the male and female hinge elements to a disassembly position allows the male and female hinge elements to be engaged to assemble the ladder or disengaged to disassemble the ladder.

13. The ladder of claim 1, wherein the internal cam surface is provided on a moveable cam element, and the cam element is moved relative to the male hinge element to move the male and female hinge elements to the locked and unlocked positions.

* * * * *